US007276034B1

(12) United States Patent
Elnar

(10) Patent No.: US 7,276,034 B1
(45) Date of Patent: Oct. 2, 2007

(54) WATER DRIVEN ROLLER MASSAGER

(76) Inventor: Joseph G. Elnar, 2954 Rubidoux Blvd., Riverside, CA (US) 92509

( * ) Notice: Subject to any disclaimer, the term of this patent is extended or adjusted under 35 U.S.C. 154(b) by 496 days.

(21) Appl. No.: 10/787,458

(22) Filed: Feb. 27, 2004

(51) Int. Cl.
*A61H 1/00* (2006.01)

(52) U.S. Cl. ..... 601/55; 601/112; 601/158

(58) Field of Classification Search ..... 601/55, 601/98, 99–101, 103–104, 112–117, 157–158
See application file for complete search history.

(56) References Cited

U.S. PATENT DOCUMENTS

| | | | | |
|---|---|---|---|---|
| 1,198,544 | A | 9/1916 | Heal | |
| 4,313,432 | A | 2/1982 | Sievers | 128/37 |
| 4,498,463 | A * | 2/1985 | Roming | 601/75 |
| 5,797,859 | A * | 8/1998 | Prehodka | 601/22 |
| 6,387,063 | B1 * | 5/2002 | Elnar | 601/99 |
| 6,641,548 | B2 | 11/2003 | Elnar | 601/155 |
| 6,843,777 | B2 * | 1/2005 | Togno | 601/55 |

* cited by examiner

*Primary Examiner*—Michael A. Brown
(74) *Attorney, Agent, or Firm*—Kenneth L. Green; Edgar W. Averill, Jr.

(57) ABSTRACT

A water driven massager mounted in an opening in the wall of a spa. The massager includes a main housing secured to the wall opening and extending outwardly from the wall (i.e., away from a spa user). A gear housing is mounted in the main housing and contains a drive mechanism rotationally connecting between a turbine and a rotating massager. The drive mechanism includes two in-series planetary gear sets for reducing Revolutions Per Minute (RPM) of the rotating massager. The rotating massager includes a plurality of rotating balls held in a ball plate residing proximal to the plane of a spa surface of the wall (i.e., the spa wall surface facing the user), and is covered by a boot providing a massager surface. The ball plate rotates at between 50 and 80 RPM thereby providing a rotating massage on the surface of the boot. The gear housing is easily removed through the wall opening for service and maintenance.

17 Claims, 6 Drawing Sheets

WATER DRIVEN ROLLER MASSAGER

BACKGROUND OF THE INVENTION

The present invention is for a water driven roller massager, and more particularly for a water driven roller massager suitable for mounting in an opening in the wall of a spa, and for a method for the function of the massager.

Water driven massagers are known and one such massager is shown in U.S. Pat. No. 1,198,544 issued Sep. 19, 1916 for "Vibrator." The vibrator of the '544 patent utilizes an unbalanced rotor driven by a stream of water, which water then passes outwardly through a screen on the face of the rotor. U.S. Pat. No. 1,948,167 issued Feb. 20, 1934 for "Vibrating Device," shows a vibrator which also uses an eccentric rotor, which is turned by a jet of water.

U.S. Pat. No. 4,313,432 issued Feb. 2, 1982 for "Water driven personal massager," teaches a water driven personal massager, which directs a stream of water against an eccentrically weighted turbine. Water passes through a hose to a hand holdable massager, drives a vibrating member, and passes outwardly through holes in the body of the massager.

U.S. Pat. No. 6,387,063 issued May 14, 2002 for "Vertically-Oscillating Spa Massager," describes a mechanism for converting a flow of water into rotational motion of a turbine, and rotational motion of the turbine into vertically-oscillating motion of a massager. U.S. Pat. No. 6,641,548 issued Nov. 4, 2003 for "Water Driven Vibrating Massager," teaches a water driven massager mountable to a spa wall, the massager having an eccentrically weighted turbine, the massager being adapted to replace a standard water jet. Although the oscillating and vibrating massagers taught by the '063 and "548 patents provide a vibrating massage desired by many users, some users prefer a rotating massager.

A rotating massager preferably includes a drive mechanism to reduce a turbine Revolutions Per Minute (RPM) to a slower massager RPM, thus adding to the complexity of the design. Also, due to the environment spas typically are used in (for example, outside) it is common for foreign matter to enter the turbine, which may jam the massager and require service. In order to provide an economically serviceable massager (e.g., to repair a drive mechanism or clear a jammed turbine), it is desirable to provide a unitized design that may be removed for service without accessing the rear (or outside) of a spa wall. The combination of these features is not available in known massagers.

BRIEF SUMMARY OF THE INVENTION

It is an object of the present invention to provide a water driven rotating massager mounted in an opening in the wall of a spa. The massager includes a main housing secured to the wall opening and extending outwardly from the wall (i.e., away from a spa user). A gear housing is mounted in the main housing and contains a drive mechanism rotationally connecting between a turbine and a rotating massager. The drive mechanism includes two in-series planetary gear sets for reducing Revolutions Per Minute (RPM) of the rotating massager. The rotating massager includes a plurality of rotating balls held in a ball plate residing proximal to the plane of a spa surface of the wall (i.e., the spa wall surface facing the user), and is covered by a boot providing a massager surface. The turbine rotates at 1500 to 2000 RPM. The RPM reduction is preferably twenty five to one. The ball plate rotates at between 50 and 80 RPM thereby providing a rotating massager on the surface of the boot. The gear housing is easily removed through the wall opening for service and maintenance.

The present invention further provides a massager mountable in a spa wall, said spa wall having a massager opening therein, a spa surface, and an outer surface. The massager includes a main housing having a wall mounting end supportable in said massager opening, an exterior end opposite the wall mounting end, and a main housing interior space. The massager further includes a gear housing having a turbine end and a massager end, said gear housing being removably supported in said interior space of said main housing, wherein said massager end resides proximal to said spa surface, said gear housing being removable from said main housing through said main housing wall mounting end. A turbine residing at said turbine end of said gear housing provides motion to a rotating massager mechanically coupled to said turbine and residing proximal to said massager end of said gear housing, wherein the massager extends past the spa surface and into the spa.

DETAILED DESCRIPTION OF THE INVENTION

Figure 1:
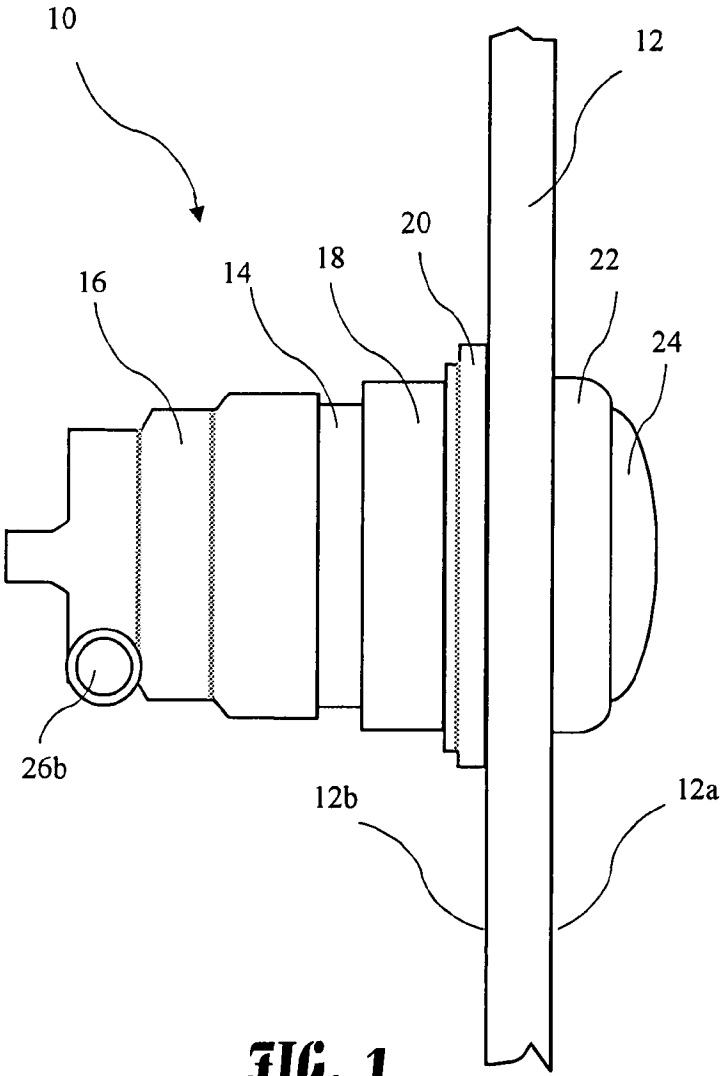
FIG. 1 is a side view of a rotating massager mounted in the wall of a spa.

The present invention provides a water driven rotating massager 10 mounted in an opening in the wall 12 of a spa as shown in FIG. 1. The massager 10 comprises a beauty ring 22 and boot 24 residing on the spa surface 12*a* side of the wall 12. A main housing seal 20, main housing nut 18, and turbine housing 16 reside behind the outside surface 12*b* side of the wall 12. A portion of the main housing 14 is visible, and the water outlet 26*b* is seen in an end view.

Figure 2:
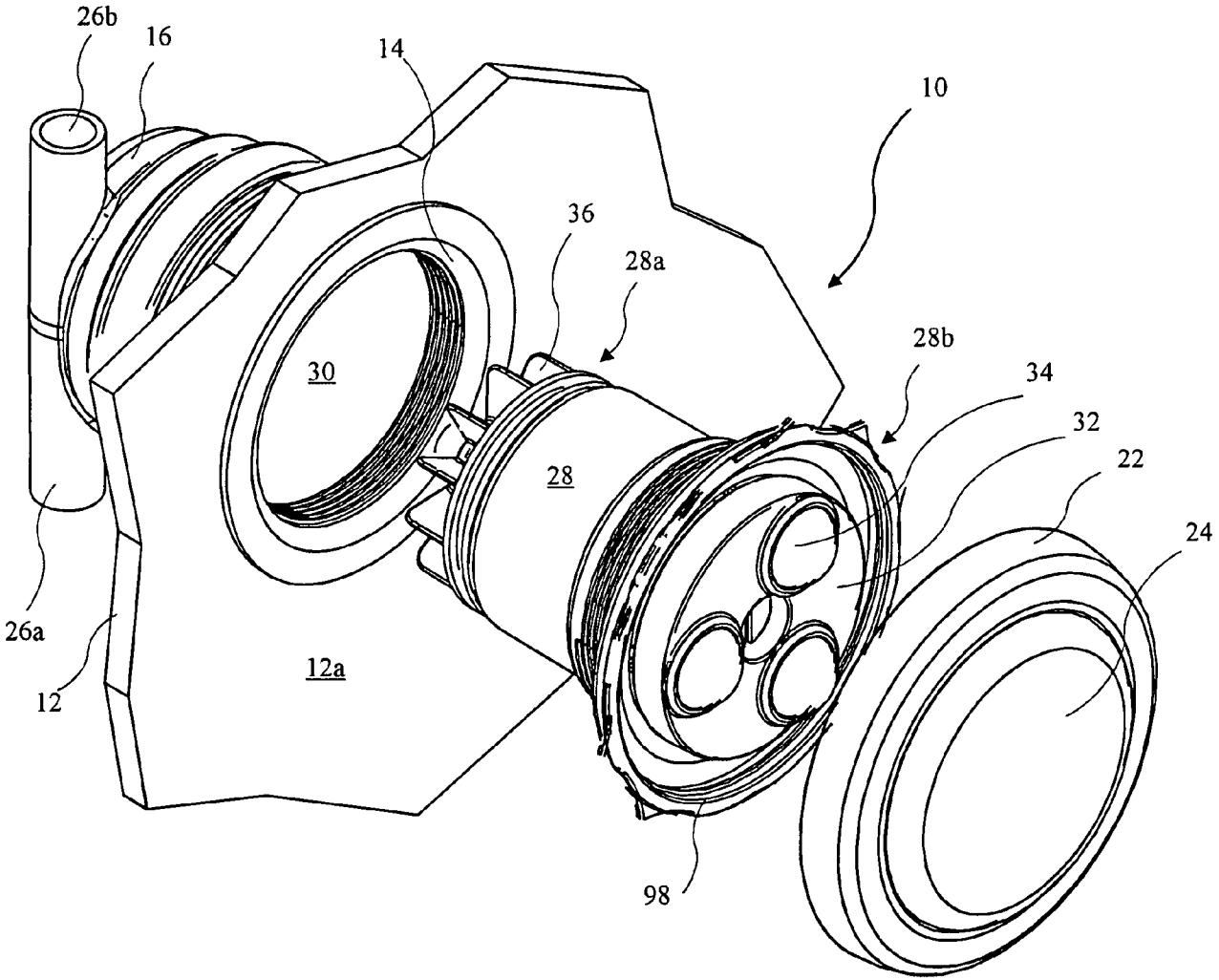
FIG. 2 is an exploded perspective view of the rotating massager of the present invention.

An expanded view of the massager 10 is shown in FIG. 2. A water inlet 26*a* is opposite the water outlet 26*b*. A gear housing 28 is shown removed from an interior space 30 of the main housing 14. A turbine 36 resides at a turbine end 28*a* of the gear housing 28, and a ball plate 32 and three balls 34 reside at a massager end 28*b* of the gear housing 28. The gear housing 28 preferably includes a handle portion 98 graspable from the gear housing massager end 28*b* whereby the gear housing 28 may be manipulated to be released from the main housing 14. While FIG. 2 shows a massager with three balls, a massager with at least one ball is intended to come within the scope of the present invention. Advantageously, the drive mechanism of the massager 10 is contained in the gear housing 28, and the turbine 36, the ball plate 32, and balls 34 are connected to the gear housing 28. Thus, the massager 10 may be easily serviced, and the turbine may be easily cleaned, by removing the gear housing 28 as a single unit.

Figure 3:
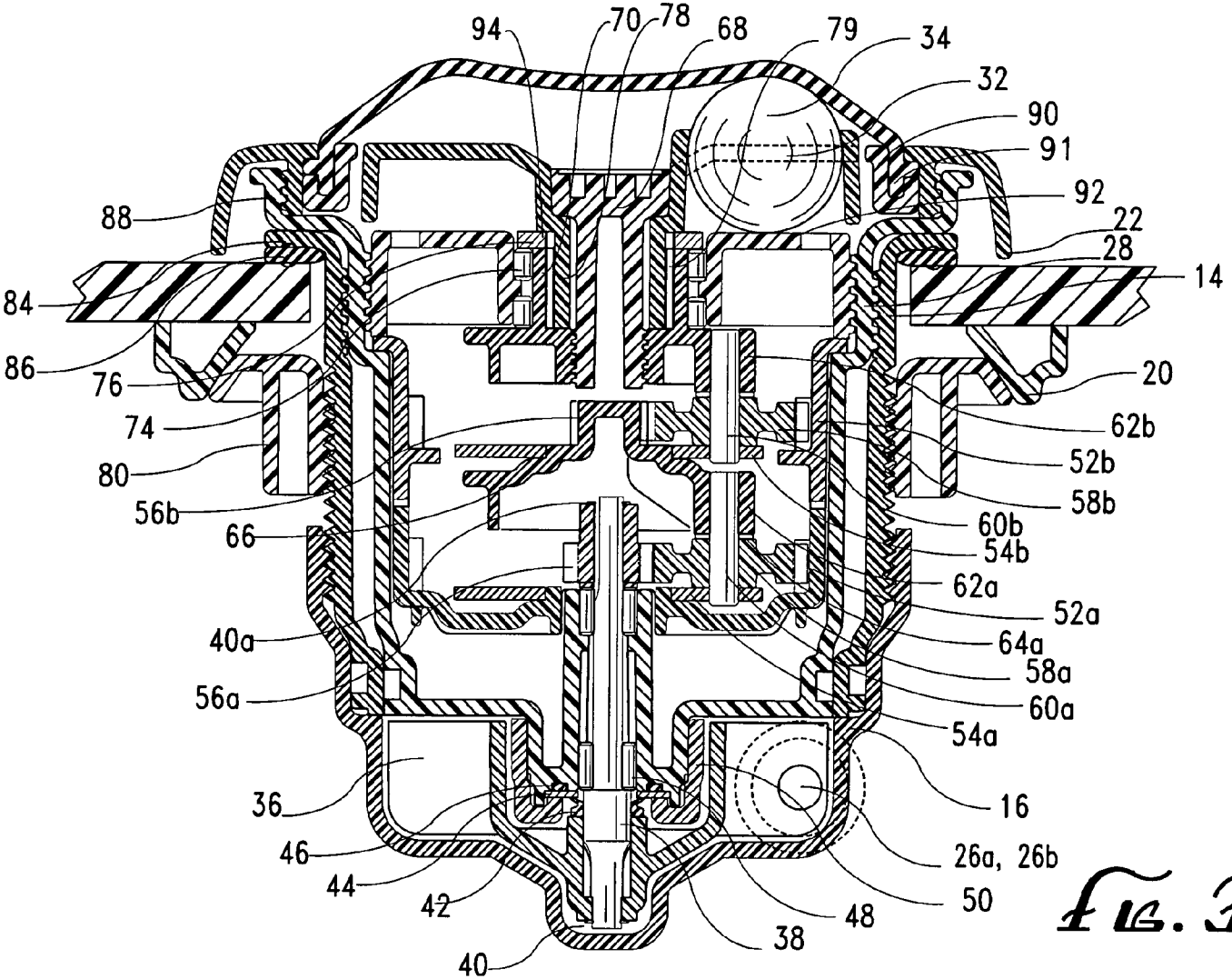
FIG. 3 is a cross-sectional view of the rotating massager.

A detailed cross-sectional view of the rotating massager 10 is shown in FIG. 3. The main housing 14 is secured in the opening in the wall 12. The gear housing 28 is threadably secured to the main housing 14, and resides in the interior space 30 (see FIG. 2). The turbine housing 16 is similarly threadably secured to the main housing 14 and resides over the turbine 36. A main housing nut 80 is tightened against the main housing washer 20 to hold the main housing 14 against the outer surface 12*a* of the wall 12. A main housing flange 84 and a main housing seal 86 further cooperate with the main housing nut 80 and the main housing washer 20 to hold the main housing 16 against the spa surface 12*a* of the wall 12, wherein the main housing 16 is secured to the wall 12 by pinching the wall 12 between the main housing washer 20 and the main housing seal 86. The gear housing 28 includes a gear housing flange 88 reaching past the main housing flange 84. The beauty ring 22 threadably engages the gear housing flange 88, and the boot 24 includes a boot lip 91 held between beauty ring 22 and a boot ring 90.

Continuing with FIG. 3, The turbine 36 is held on a turbine shaft 38 by a shaft retaining ring 40. A Forsheda® (i.e., face running) seal 42, bottom washer 44, and O-ring 46 reside between the turbine 36 and a turbine shaft bearing 48. A seal retainer cup 50 further resides at the turbine end 28*a* of the gear housing 28 and cooperates with the Forsheda® seal 42.

The turbine shaft 38 passes through a first gear ring 52*a* (not rotating) and a first gear plate 54*a* (rotating) and couples the turbine 36 to a first pinion gear 56*a*. A second shaft retaining ring 40*a* retains the pinion gear 56*a* on the turbine shaft 38. The pinion gear 56*a* cooperates with a plurality of first orbit gears 58*a* residing on a respective plurality of first orbit gear shafts 60*a*, which orbit gear shafts 60*a* orbitally couple the orbit gears 58*a* with a first gear hub 62*a*, wherein one of a plurality of first orbit washers 64*a* resides on each orbit gear shaft 60*a* between each orbit gear 58*a* and the gear hub 62*a*.

The gear hub 62*a* defines a second pinion gear 56*b*. A second gear plate 54*b* resides over the pinion gear 56*b* and rests on a hub shoulder 66. The pinion gear 56*b* cooperates with a plurality of second orbit gears 58*b* residing on a respective plurality of second orbit gear shafts 60*b*, which orbit gear shafts 60*b* orbitally couple the orbit gears 58*b* with a second gear hub 62*b*, wherein one of a plurality of second orbit washers 64*b* resides on each orbit gear shaft 60*b* between each orbit gear 58*b* and the gear hub 62*b*. A ball plate screw 68 attaches the ball plate 32 to the gear hub 62*b*, wherein the gear hub 62 includes a nose piece 70 having an internal hub spline 72 (see FIG. 4), and wherein the hub spline 72 cooperates with an external spline 79 of an attaching portion 78 of the ball plate 32, to rotationally couple the ball plate 32 to the gear hub 62*b*. Turning the ball plate 32 causes the balls 34 to rotate with respect to the ball plate 32. Each of the planetary gear assemblies described above preferably provides a reduction of five to one, thereby achieving a twenty five to one total reduction in rotational speed from the turbine 36 to the ball plate 32.

The balls 34 are held in place between the ball plate 32 and a gear housing cap 92 (does not rotate) which is threadably attached to the gear housing 28. Gear hub bearing 74 resides between the gear hub 62*b* and the gear housing cap 92 (also see FIG. 4), wherein the gear housing cap 92 is threadably attached to the gear housing 28. A thrust washer 76 resides between the gear hub bearing 74 and a ball plate shoulder 94 of the ball plate 34. While in the embodiment described above, the rotating massager preferably includes a plurality of rotating balls, in other embodiments, the rotating massager may include a wavy surface rotating under the boot, or any other apparatus suitable for providing a rotating sensation on the surface of the boot.

Figure 4:
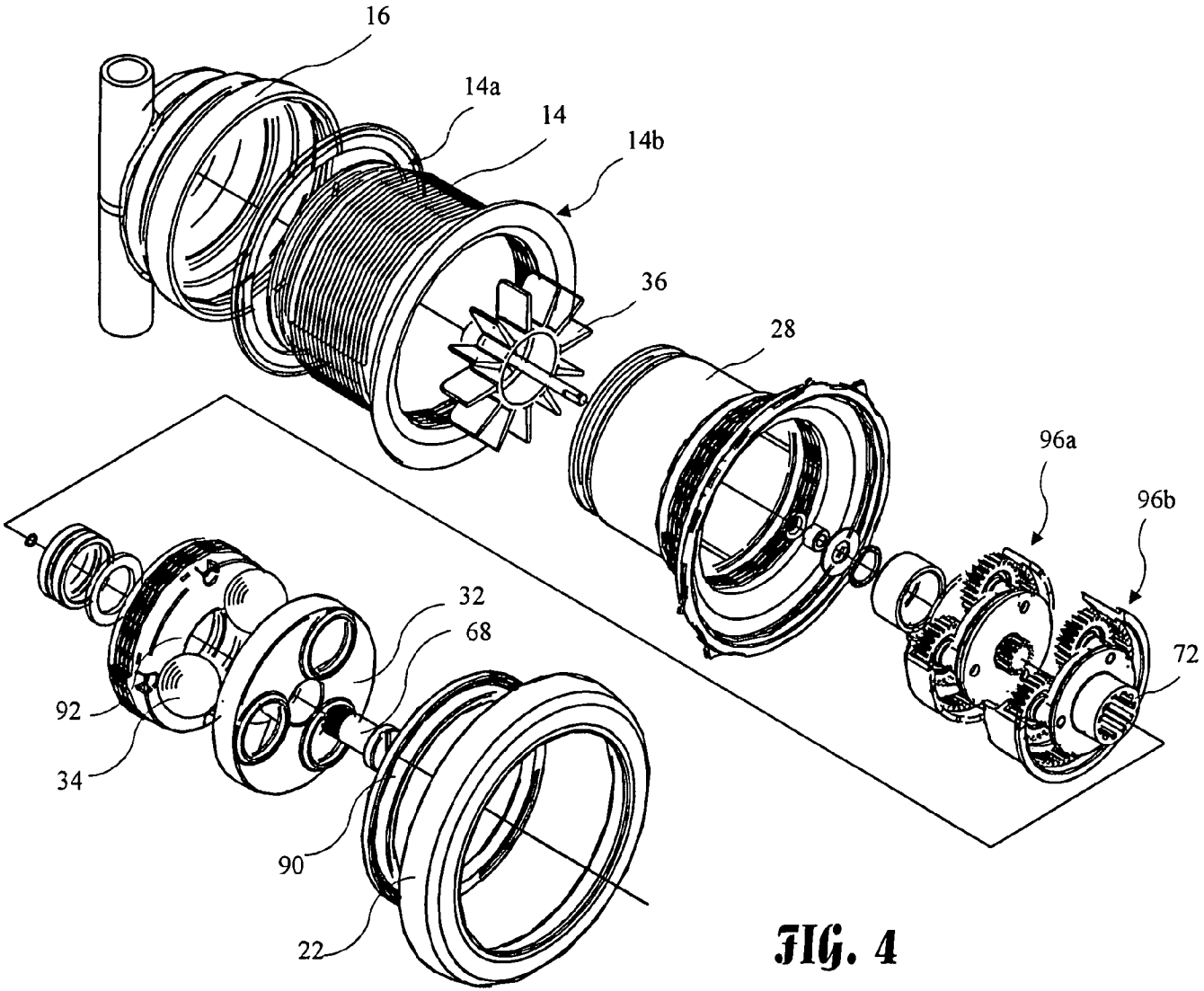
FIG. 4 is an exploded perspective view of the major components of the rotating massager.

An expanded view of the rotating massager 10 is shown in FIG. 4, showing various elements of the present invention, including a first planetary gear assembly 96*a* and a secondary planetary gear assembly 96*b*. The main housing 14 defines a wall mounting end 14*b* defining the main housing flange 84, and an exterior end 14*a* opposite the wall mounting end 14*b*, wherein the exterior end 14*a* provides support for the turbine housing 16. An additional expanded view of the planetary gear assembly 96*a* is shown in FIG. 5.

While the embodiment above describes coupling the turbine to the rotating massager using two planetary gear assemblies, the turbine may be mechanically coupled to the rotating massager by other mechanical couplings including other gear arrangements, and preferably by at least one planetary reduction gear assembly, and more preferably by two planetary reduction gear assemblies in series. However, other methods such as rollers or belts may be used to couple the turbine and rotating massager while reducing Revolutions Per Minute (RPM), and any rotating massager having such other embodiments for coupling with RPM reduction, are intended to come within the scope of the present invention. The rotating massager is preferably mechanically coupled to turn at approximately one twenty fifth the rate of rotation of the turbine. The turbine preferable turns at approximately 1500 to approximately 2000 RPM and the rotating massager is preferably adapted to rotate at approximately fifty to approximately eighty RPM.

Figure 5:
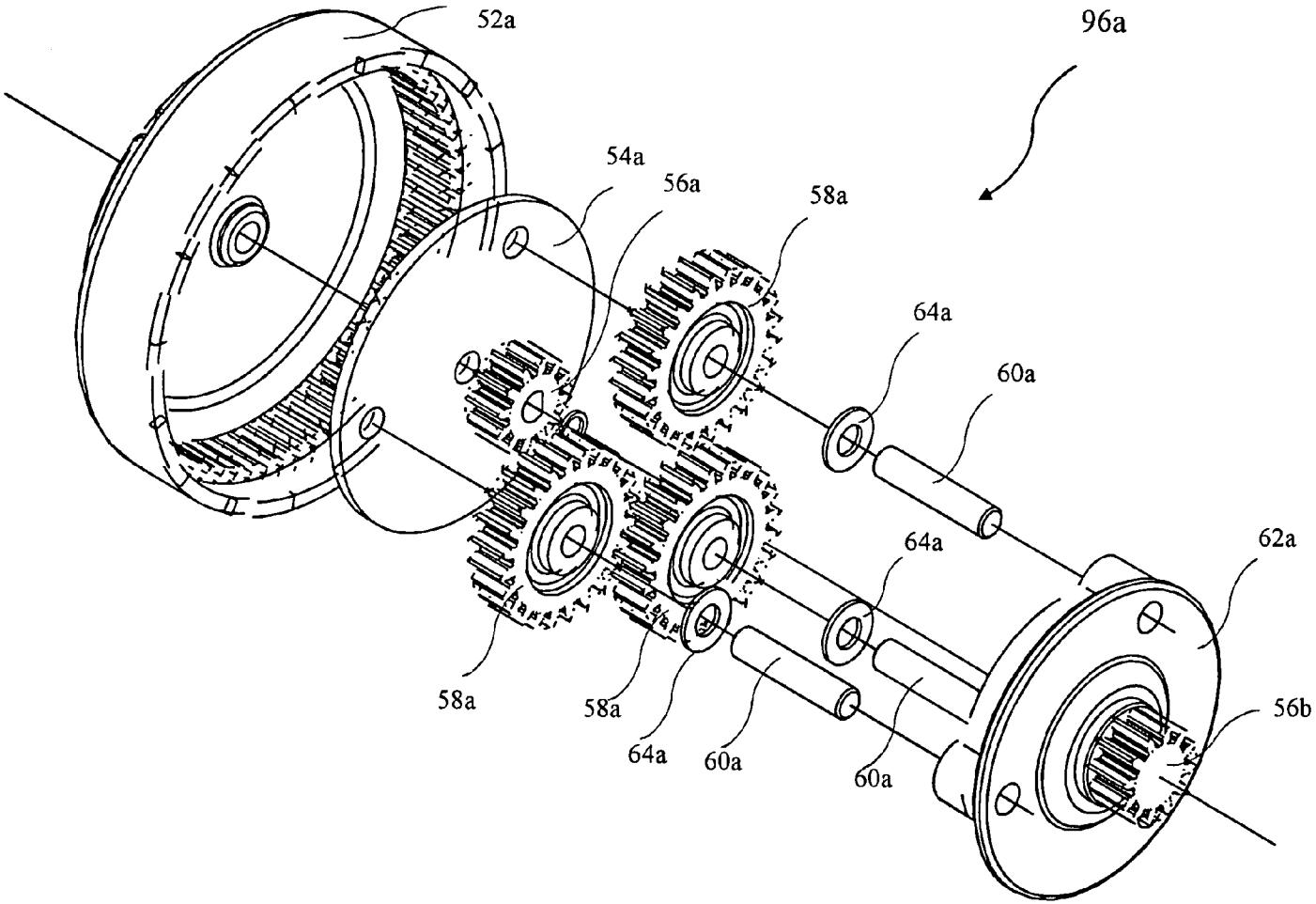
FIG. 5 is an exploded perspective view of a planetary gear assembly used in the present invention.

As seen in FIGS. 3-5, the massager 10 includes a drive mechanism to reduce a turbine RPM to a slower massager RPM. Advantageously, the drive mechanism is contained in the gear housing 28, and the gear housing 28 is easily removable from the main housing 14 through the main housing 14 wall mounting end 14*b*, thus facilitating maintenance and service of the massager 10. The turbine 36 is also removable with the gear housing 28, thus facilitating cleaning of the turbine 36.

The present invention further includes a method for providing a massage. The method comprises injecting a flow of water through a turbine, spinning a turbine shaft, rotationally coupling the turbine shaft to a massager through a mechanical couple, and rotating the massager at a reduced rotational speed. Spinning a turbine shaft preferably comprises spinning a turbine shaft at from approximately 1500 Revolutions Per Minute (RPM) to approximately 2000 RPM, and rotating the massager preferably comprises rotating the massager at from approximately 50 Revolutions Per Minute (RPM) to approximately 80 RPM, and wherein rotationally coupling preferably comprises rotating the rotating massager at approximately one twenty fifth the angular velocity of the turbine.

Figure 6A:
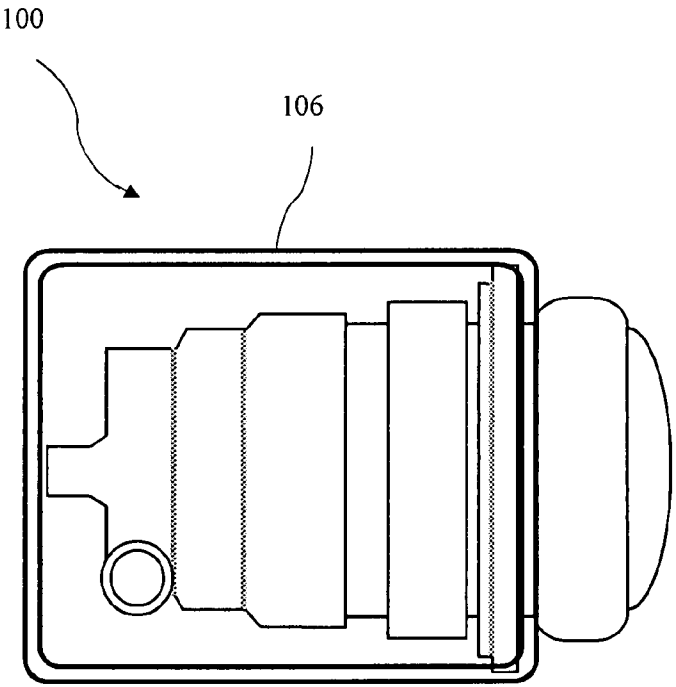
FIG. 6A is a cross-sectional view of the hand held massager taken along line 6A-6A of FIG. 6.
Figure 6:
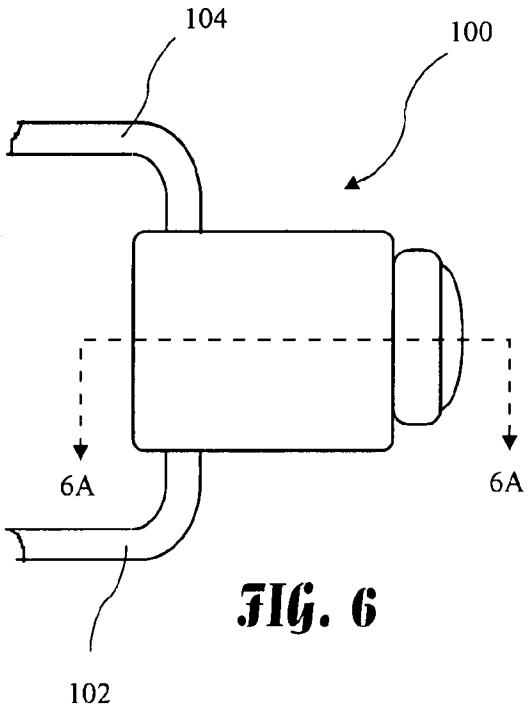
FIG. 6 is a hand held massage according to the present invention.

The present invention may further be exercised as a hand held massager 100 as shown in FIG. 6. The hand held massager 100 includes inlet line 102 and outlet line 104 for providing flow to the turbine 36 (see FIG. 2 or 4). Alternatively, the outlet line 104 may be eliminated, wherein the flow may simply be discharged from the hand held massager 100. A cross-sectional view of the hand help massager 100 taken along line 6A-6A of FIG. 6 is shown in FIG. 6A, wherein the massager 100 includes a casing 106. The casing 106 may further include a handle or a gripping surface to aid in holding the massager 100.

It is thus seen that the present invention provides a water powered wall mountable massager comprising a water inlet residing behind the wall for receiving a flow of water, a turbine residing behind the wall, wherein the turbine is rotatable by the flow of water, and a rotating massager connected to the turbine through a rotation rate reduction mechanism. The rotating massager extends through the spa wall to provide a rotating massager for a user preferably sitting against the spa wall. The rotation rate reduction mechanism preferably comprises two stages of in-series planetary gear sets for reducing Revolutions Per Minute (RPM). The turbine preferably rotates at between 1500 and 2000 RPM. Each planetary gear set preferably reduces the RPM by one fifth. For example, a first planetary gear set may reduce the RPM from 1500 to 300, and a second planetary gear set may further reduce the RPM from 300 to 60. The rotating massager preferably comprises a plurality of balls held by a rotating ball plate which rotates about a central axis of the gear housing. The ball plate rotates at between 50 and 80 RPM thereby providing a rotating massager on the surface of the boot.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A massager mountable in a spa wall, said spa wall having a massager opening therein, a spa surface, and an outer surface, the massager comprising:

a main housing having a wall mounting end supportable in said massager opening, an exterior end opposite the wall mounting end, and a main housing interior space;

a gear housing having a turbine end and a massager end, said gear housing being removably supported in said interior space of said main housing, wherein said massager end resides proximal to said spa surface, said gear housing being removable from said main housing interior space through said main housing wall mounting end;

a turbine residing at said turbine end of said gear housing; and a rotating massager mechanically coupled to said turbine and residing proximal to said massager end of said gear housing, wherein said rotating massager extends past the spa surface and into the spa.

2. The massager of claim 1, wherein the gear housing is threadably secured to said main housing.

3. The massager of claim 1, wherein the turbine is mechanically coupled to said rotating massager by gears.

4. The massager of claim 3, wherein the turbine is mechanically coupled to said rotating massager by at least one planetary gear assembly.

5. The massager of claim 4, wherein the at least one planetary gear assembly comprises two planetary gear assemblies in series.

6. The massager of claim 3, wherein the rotating massager is mechanically coupled to turn at approximately on twenty fifth the rate of rotation of the turbine.

7. The massager of claim 1, wherein the rotating massager is adapted to rotate at approximately fifty to approximately eighty Revolutions Per Minute (RPM).

8. The massager of claim 1, further including a water inlet and a water outlet disposed behind said outer surface.

9. The massager of claim 8, further including a turbine housing attached to said main housing exterior end, said turbine housing including the water inlet and the water outlet, wherein the gear housing including the turbine is removable from said main housing interior space through said main housing wall mounting end without removing the turbine housing.

10. The massager of claim 1, wherein the rotating massager comprises a plurality of balls held by a rotating ball plate adapted to rotate about a central axis of said gear housing.

11. The massager of claim 7, wherein the plurality of balls comprises three balls.

12. The massager of claim 7, further including a boot covering the plurality of balls.

13. The massager of claim 1, wherein the gear housing includes a handle portion graspable from the gear housing massager end whereby the gear housing may be manipulated to be released from said main housing.

14. A method for providing a massage, the method comprising:

injecting a flow of water through a turbine residing behind a spa wall;

directing the flow of water against blades of a turbine to spin the turbine;

coupling the rotation of the turbine to a pinion gear of a planetary gear set; and rotationally coupling the rotation of the pinion gear through the planetary gear set to a rotating massager residing proximal to a spa wall, wherein the coupling through the planetary gear set reduces the rotational speed of the rotating massager relative to the turbine.

15. The method of claim 14 wherein spinning a turbine shaft comprises spinning a turbine shaft at from approximately 1500 Revolutions Per Minute (RPM) to approximately 2000 RPM.

16. The method of claim 14 wherein rotationally coupling the turbine shaft to a massager comprises rotating the massager at from approximately 50 Revolutions Per Minute (RPM) to approximately 80 RPM.

17. The method of claim 14, wherein rotationally coupling comprises rotationally coupling the turbine to the massager wherein the massager rotates at approximately one twenty fifth the angular velocity of the turbine.

* * * * *